US007617648B2

(12) United States Patent
Moody

(10) Patent No.: US 7,617,648 B2
(45) Date of Patent: Nov. 17, 2009

(54) THERMAL FRAMING COMPONENT

(75) Inventor: Donald R. Moody, Denton, TX (US)

(73) Assignee: Nucon Steel Corporation, Denton, TX (US)

( * ) Notice: Subject to any disclaimer, the term of this patent is extended or adjusted under 35 U.S.C. 154(b) by 506 days.

(21) Appl. No.: 10/711,118

(22) Filed: Aug. 25, 2004

(65) Prior Publication Data

US 2005/0055934 A1 Mar. 17, 2005

Related U.S. Application Data

(60) Provisional application No. 60/497,674, filed on Aug. 25, 2003.

(51) Int. Cl.
*E04B 2/58* (2006.01)

(52) U.S. Cl. ..... 52/481.1; 52/483.1; 52/714; 52/715; 52/656.1

(58) Field of Classification Search ..... 52/733.2, 52/731.1, 354, 731.5, 656.1, 290, 357–364, 52/720.1, 414, 481.1, 481.2, 309.9, 309.11, 52/309.12, 426, 428, 431, 565, 731.7, 731.9, 52/238.1, 241, 407.4, 281, 715, 479, 714, 52/763, 764, 770, 483.1
See application file for complete search history.

(56) References Cited

U.S. PATENT DOCUMENTS

| | | | | |
|---|---|---|---|---|
| 867,251 | A * | 10/1907 | Davis | 52/354 |
| 876,399 | A | 1/1908 | Robinson | |
| 1,074,242 | A * | 9/1913 | Caldwell | 52/354 |
| 1,130,722 | A * | 3/1915 | Fletcher | 52/355 |
| 1,481,249 | A * | 1/1924 | Beinecke | 52/505 |
| 1,867,194 | A | 7/1932 | Taylor | |
| 1,867,329 | A | 7/1932 | Ryan | |
| 1,905,616 | A | 4/1933 | Zanella | |
| 2,185,335 | A * | 1/1940 | Fischer | 52/426 |

(Continued)

FOREIGN PATENT DOCUMENTS

| | | |
|---|---|---|
| CA | 1079473 | 6/1980 |

(Continued)

OTHER PUBLICATIONS

U.S. Appl. No. 10/711,822, Non-Final Office Action dated Feb. 26, 2008.

(Continued)

*Primary Examiner*—Richard E Chilcot, Jr.
*Assistant Examiner*—Matthew J Smith
(74) *Attorney, Agent, or Firm*—Matthew W. Witsil; Moore & Van Allen PLLC

(57) ABSTRACT

A thermal framing component for use in wall framing. The thermal framing component includes an elongated web with tabs in alternating positions and with at least some bent at right angles to the web. The bent tabs form slots on both sides of the web into which rigid insulation is reciprocally received. The tabs also provide mounting surfaces for exterior sheathing or finish materials. The component may be used in metal framing, wood framing, or a combination thereof. The component may improve thermal performance of a wall by limiting the heat transfer through the wall, for example, by avoiding direct paths for conduction of heat through the wall. Methods of making and installing the component and assemblies are provided.

7 Claims, 6 Drawing Sheets

U.S. PATENT DOCUMENTS

| | | | | | |
|---|---|---|---|---|---|
| 2,209,514 | A | * | 7/1940 | Drummond | 52/223.13 |
| 2,779,978 | A | * | 2/1957 | Sundelin et al. | 52/479 |
| 3,217,460 | A | | 11/1965 | Downing | |
| 3,999,343 | A | | 12/1976 | Roberts | |
| 4,361,994 | A | | 12/1982 | Carver | |
| 4,435,936 | A | | 3/1984 | Rutkowski | |
| 4,478,018 | A | | 10/1984 | Holand | |
| 4,633,634 | A | | 1/1987 | Nemmer et al. | |
| 4,702,058 | A | | 10/1987 | Bennett | |
| 5,269,109 | A | * | 12/1993 | Gulur | 52/309.9 |
| 5,325,651 | A | * | 7/1994 | Meyer et al. | 52/715 |
| 5,353,560 | A | | 10/1994 | Heydon | |
| 5,417,023 | A | | 5/1995 | Mandish | |
| 5,524,400 | A | | 6/1996 | Schmechel | |
| 5,653,079 | A | * | 8/1997 | Loeffler et al. | 52/715 |
| 5,664,378 | A | * | 9/1997 | Bettigole et al. | 52/414 |
| 5,765,330 | A | | 6/1998 | Richard | |
| 5,799,462 | A | | 9/1998 | McKinney | |
| 5,953,883 | A | * | 9/1999 | Ojala | 52/794.1 |
| 6,266,936 | B1 | * | 7/2001 | Gelin | 52/481.1 |
| 6,415,575 | B1 | | 7/2002 | Thompson | |
| 6,421,972 | B1 | | 7/2002 | Dalphond et al. | |
| 6,578,335 | B2 | | 6/2003 | Poliquin | |
| 6,615,563 | B1 | * | 9/2003 | Nanayakkara | 52/731.1 |
| 6,640,516 | B1 | * | 11/2003 | Thompson | 52/714 |
| 6,708,459 | B2 | * | 3/2004 | Bodnar | 52/356 |
| 6,711,867 | B1 | * | 3/2004 | Smith | 52/696 |
| 7,028,439 | B2 | * | 4/2006 | Foderberg et al. | 52/414 |
| 7,051,484 | B2 | * | 5/2006 | Nanayakkara | 52/481.1 |
| 7,197,854 | B2 | * | 4/2007 | Bettigole et al. | 52/414 |
| 2001/0004820 | A1 | * | 6/2001 | Poliquin | 52/481.1 |
| 2003/0014934 | A1 | * | 1/2003 | Bodnar | 52/443 |
| 2003/0056456 | A1 | | 3/2003 | Heydon | |
| 2004/0045252 | A1 | * | 3/2004 | Nanayakkara | 52/733.2 |
| 2005/0076600 | A1 | | 4/2005 | Moody et al. | |

FOREIGN PATENT DOCUMENTS

| | | |
|---|---|---|
| CA | 1166815 | 5/1984 |

OTHER PUBLICATIONS

U.S. Appl. No. 10/711,822, Non-Final Office Action dated May 28, 2008.

U.S. Appl. No. 10/711,822, Final Office Action dated Nov. 3, 2008.

* cited by examiner

THERMAL FRAMING COMPONENT

CROSS REFERENCE TO RELATED APPLICATIONS

This application claims priority from co-pending U.S. provisional application No. 60/497,674, filed Aug. 25, 2003, by the inventor hereof, the entire disclosure of which is incorporated herein by reference.

BACKGROUND

The present invention relates to steel framing components, and more particularly to steel framing components for supporting rigid insulation installed on primary structural framing in both light gauge steel and wood framing applications.

Walls of buildings may include framing made of light gauge steel, wood, or a combination thereof. In addition to structural requirements that the framing must meet, thermal characteristics are important, especially for exterior walls. Minimizing heat transfer through the walls is desirable both for comfort and for energy efficiency of heating and air conditioning. For example, when the outdoors is cold relative to inside a heated structure, heat from indoors should be prevented from passing through the walls to the outdoors. Conversely, when the outdoors is hot relative to inside an air conditioned structure, heat from outdoors should be prevented from passing through the walls to the inside. The degree of prevention of heat transfer may be based on considerations of technical feasibility as well as cost.

Heat transfer through walls may be addressed in a variety of ways. Framing may include a top plate, a bottom plate or sill, vertical posts or studs, and mid-section blocking, among other components. Spun fiberglass insulation is commonly placed in the cavities formed by the framing components. Rigid insulation, such as expanded or extruded polystyrene, may also be used. Another method is to inject foam insulation into the cavities. While each of these methods reduces conduction of heat through the areas between framing components, they do not address conduction through the components themselves, which may present a direct and continuous path for heat transfer across the wall. Although heat conduction is of concern with wood framing, it is of even greater concern in metal framing, which has a significantly higher heat transfer coefficient than wood.

Several known designs for insulating walls with metal members attempt to minimize heat transfer by using rigid insulation. The metal members may be, among other things, "C" shaped in cross-section, meaning having a web, first and second flanges generally perpendicular to the web, and returns on each flange, or "U" shaped in cross-section, having a web and first and second flanges generally perpendicular to the web, without returns. The flanges of the members are sometimes embedded in the rigid insulation in slots that are formed by "hot-wiring" the insulation. Such construction adds to the complexity of manufacturing and fabrication, and limits the ability to make on-site modifications.

For the foregoing reasons, there exists a need for a framing component that supports rigid insulation, limits heat transfer through a wall and in particular direct conduction through wall framing, is relatively easy and quick to install, and may allow field modifications.

SUMMARY OF THE INVENTION

In accordance with an embodiment of the present invention, a thermal framing component for use in wall framing includes an elongated planar web including a longitudinal axis, a first edge parallel to the longitudinal axis, and a second edge parallel to the longitudinal axis. The web has first and second sides. A first tab extends from the first edge at approximately a 90 degree angle from the first side, a second tab extends from the first edge at approximately a 90 degree angle from the second side, and a third tab extends from the second edge at approximately a 90 degree angle from the second side. A fourth edge may extend from the first or second edge in the same plane as the planar web. Alternatively, a fourth tab may extend from the second edge at approximately a 90 degree angle from the first side. Position may be varied, for example, by having tabs along each edge consistently alternate in direction of bending, or by having opposing tabs across the web bent in the same or opposite direction from each other.

In accordance with an embodiment of the present invention, a thermal framing component for use in wall framing includes an elongated planar web including a longitudinal axis, a first edge parallel to the longitudinal axis, and a second edge parallel to the longitudinal axis. The web has first and second sides. A first tab extends from the first edge at approximately a 90 degree angle from the first side, a second tab extends from the first edge at approximately a 90 degree angle from the second side, and a third tab extends from the second edge at approximately a 90 degree angle from the second side. A fourth tab extends from the second edge at approximately a 90 degree angle from the first side. The first and third tabs are in longitudinal registration and the second and fourth tabs are in longitudinal registration. Alternatively, the first and fourth tabs are in longitudinal registration and the second and third tabs are in longitudinal registration.

In accordance with another embodiment of the present invention, a thermal framing assembly for use in wall framing includes a top plate, a bottom plate, and a thermal framing component. The thermal framing component includes an upper end and a lower end, the upper end mounted to the top plate and lower end mounted to the bottom plate. The thermal framing component includes an elongated planar web including a longitudinal axis, a first edge parallel to the longitudinal axis, and a second edge parallel to the longitudinal axis. The web has first and second sides. A first tab extends from the first edge at approximately a 90 degree angle from the first side, a second tab extends from the first edge at approximately a 90 degree angle from the second side, and a third tab extends from the second edge at approximately a 90 degree angle from the second side. Rigid insulation has an edge in close and complementary registration with a side of the web. Mid-span blocking may also be provided.

In accordance with another embodiment of the present invention, a thermal framing assembly for use in wall framing includes a top plate, a bottom plate, a wall stud, and a thermal framing component. The wall stud includes an upper end and a lower end. The upper end is mounted to the top plate and lower end is mounted to the bottom plate. The thermal framing component is mounted along the wall stud below the top plate and above the bottom plate. The thermal framing component includes an elongated planar web including a longitudinal axis, a first edge parallel to the longitudinal axis, and a second edge parallel to the longitudinal axis. The web has first and second sides. A first tab extends from the first edge at approximately a 90 degree angle from the first side, a second tab extends from the first edge at approximately a 90 degree angle from the second side, and a third tab extends from the second edge at approximately a 90 degree angle from the second side. Rigid insulation has an edge in close and complementary registration with a side of the web. Mid-span blocking may also be provided.

In accordance with another embodiment of the present invention, a method of making a thermal framing component is provided. An elongated metal strip is provided including two parallel edges and a longitudinal axis. A portion of the strip is designated as a web, the web having two edges substantially parallel to and spaced from the strip edges. At least at two locations the strip is cut, or an equivalent means such as punching, from each strip edge to the proximate web edge along a path substantially perpendicular to the respective strip edge to form a tab along each web edge. The strip is broken, or bent, along each web edge to bend the tabs to be substantially perpendicular to the web. The tabs may be in longitudinal registration or offset from each other.

In accordance with another embodiment of the present invention, a method of installing a thermal framing assembly is provided. A top plate and a bottom plate are provided with the bottom plate substantially parallel to and spaced from the top plate. First and second thermal framing components are provided, each including an upper end and a lower end. The upper end of each thermal framing component is mounted to the top plate and each lower end to the bottom plate. Each thermal framing component includes an elongated planar web including a longitudinal axis, a first edge parallel to the longitudinal axis, a second edge parallel to the longitudinal axis. The web has first and second sides. A first tab extends from the first edge at approximately a 90 degree angle from the first side, a second tab extends from the first edge at approximately a 90 degree angle from the second side, and a third tab extends from the second edge at approximately a 90 degree angle from the second side. Rigid insulation is provided including two substantially parallel edges, and the rigid insulation is inserted between the two thermal components causing the edges to be in close and complementary registration with a side of the web of each component.

In accordance with another embodiment of the present invention, a method of installing a thermal framing assembly includes providing a top plate and a bottom plate substantially parallel to and spaced from the top plate. First and second wall studs are provided, each including an upper and a lower end. The upper end of each wall stud is mounted to the top plate and the lower end of each wall stud is mounted to the bottom plate. First and second thermal framing components are provided. The first thermal framing component is mounted to the first wall stud and the second thermal framing component is mounted to the second wall stud, with the mounting locations below the top plate and above the bottom plate. Each thermal framing component includes an elongated planar web including a longitudinal axis, a first edge parallel to the longitudinal axis, a second edge parallel to the longitudinal axis. The web has first and second sides. A first tab extends from the first edge at approximately a 90 degree angle from the first side, a second tab extends from the first edge at approximately a 90 degree angle from the second side, and a third tab extends from the second edge at approximately a 90 degree angle from the second side. Rigid insulation is provided, including two substantially parallel edges. The rigid insulation is inserted between the two thermal components causing the edges to be in close and complementary registration with a side of the web of each component.

Features and advantages of the present invention will become more apparent in light of the following detailed description of some embodiments thereof, as illustrated in the accompanying figures. As will be realized, the invention is capable of modifications in various respects, all without departing from the invention. Accordingly, the drawings and the description are to be regarded as illustrative in nature, and not as restrictive.

DETAILED DESCRIPTION OF THE INVENTION

A thermal framing component of the present invention may receive and secure rigid insulation and may also provide an attachment surface for exterior sheathing or finish materials. The thermal framing component may provide a thermal circuit break or reduce conduction of heat through framing members by limiting metal to metal contact, in particular to improve the thermal performance of steel framing structures. Mounting of thermal framing components to wood studs may further decrease heat transfer while providing stability. In general, thermal performance may be improved by attempting to minimize the direct thermal transfer through the primary structural framing components.

The thermal wall component may be fabricated from light gauge steel or other metal, and may be incorporated into conventional and proprietary wall framing components of light gauge steel or wood. The scope of the invention is not intended to be limited by materials or dimensions listed herein, but may be carried out using any materials and dimensions that allow the construction and operation of the present invention. Materials and dimensions depend on the particular application. Metal primary structural framing members may be "C" shaped, "U" shaped, or other shape as selected by one of ordinary skill in the art. Certain relative dimensions, sizes, and spacings are shown on the Figures and discussed herein; it should be understood that the dimensions, sizes, and spacings shown and discussed merely illustrate selected embodiments of the invention. Further, certain terms of orientation such as"top," "bottom," "upper," "lower," "inner," "outer," "interior," and "exterior" are used for convenience and refer to the position of elements as shown in the figures, which generally correspond to installed positions, but should not be construed as limiting to the invention.

Figure 1:
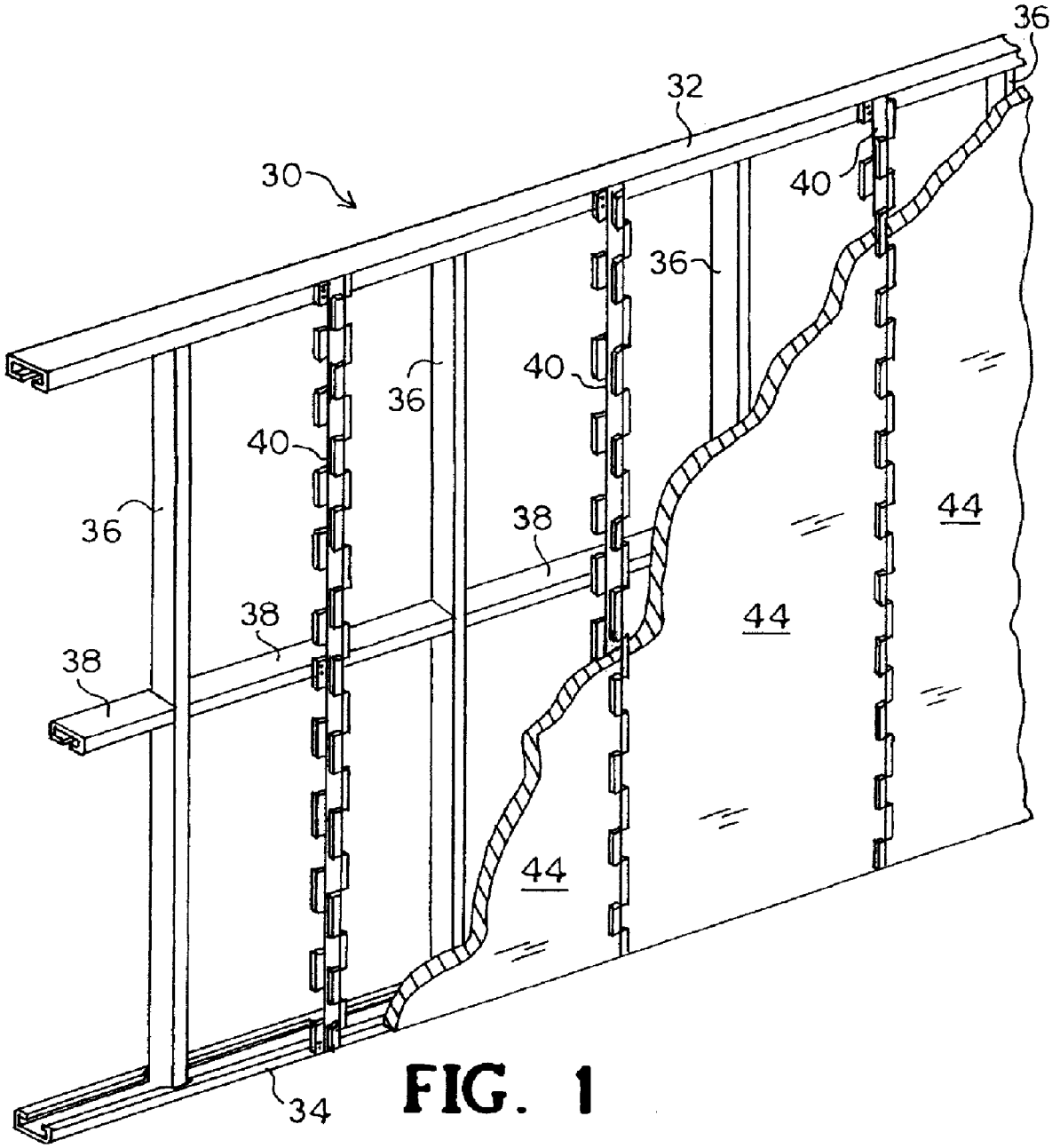
FIG. 1 is a perspective view of structural framing in a wall including thermal framing components according to the present invention.

FIG. 1 shows a thermal framing assembly 30 including a horizontal top plate 32, a horizontal bottom plate 34, vertical studs 36, horizontal mid-span blocking 38, and thermal framing components 40. Vertical studs 36 may spaced, for example, at 24 inches (61 cm) on center. Thermal components 40 may be spaced between the vertical studs 36, also 24 inches (61 cm) on center. As shown, the thermal components 40 are attached to the top plate 32, bottom plate 34, and mid-span blocking 38. Mid-span blocking 38 could be eliminated based on design considerations. Rigid insulation sheets 44, removed in part to expose the other components, extend between the thermal components 40 and between the top and bottom plates 32, 34. Although there could be vertical members to which the thermal components could be attached, none is required or shown. While the framing 32, 34, 36, 38 is shown as metal in FIG. 1, it could also be wood. Thermal components 40 could be mounted to vertical wood studs (not shown) for additional stability. Mounting the thermal components 40 to vertical metal studs is also possible, but may result in an increase of heat transfer through the wall.

Figure 2:
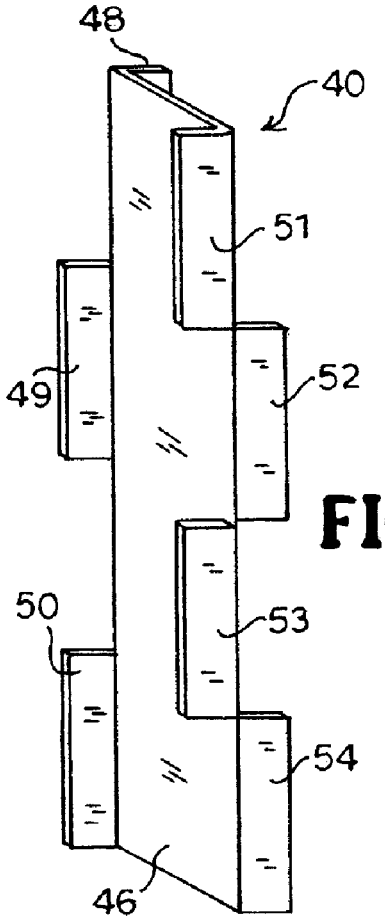
FIG. 2 is a perspective view of a portion of a thermal framing component of FIG. 1.

A portion of a thermal framing component 40 is shown in FIG. 2. The thermal framing component 40 has a web or spine 46. Along each edge of the web 46 are inner tabs 48-50 and outer tabs 51-54 that alternate in position. The lengths of the tabs may vary from that shown. One tab, across the web 46 from tab 53 and between tabs 49 and 50, is hidden from view behind the web 46, but should be understood to be similar to the tabs that may be seen, and in position like that of tab 48, which also resembles the other tabs. The tabs 48-54 form a slot on each side of the web 46. The edges of rigid insulation 44 may be placed and secured in the slot, and the edge of the insulation may be in close and complementary registration with the web 46. When the term "close and complementary registration" is used herein with respect to the web 46 and insulation 44, it should be understood to mean that the edge of the insulation is proximate to or abutting the web, and that the insulation edge is reciprocally received in the slot formed by the tabs. Inner tabs 48-50 provide surfaces for mounting to the framing members (not shown), while outer tabs 51-54 provide mounting surfaces for exterior sheathing or finish material. Directly opposing tabs, for example, tabs 48 and 51, 49 and 52, and 50 and 54, could be bent in the same direction and still be according to the present invention, but are shown to be bent in opposite directions. Bending opposing tabs in opposite directions provides clear, open access to the surface of the tab that is to be attached to a framing member. Tabs that are directly across the web from each other may be considered to be in "longitudinal registration."

Figure 3:
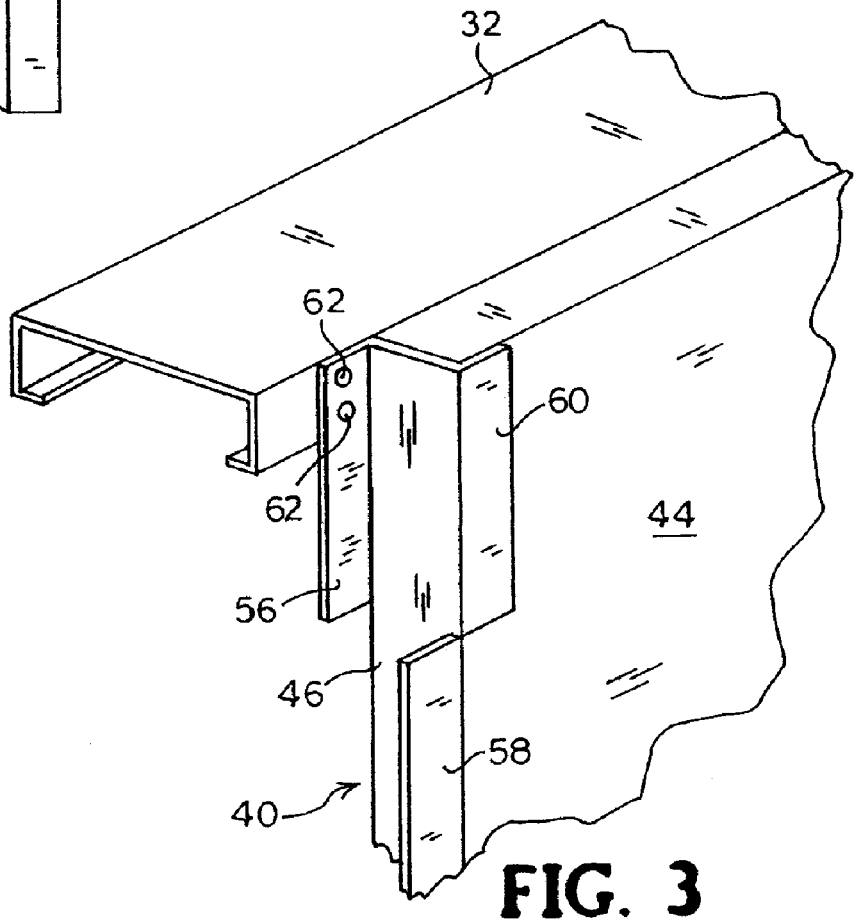
FIGS. 3-5 are perspective views of connections of the thermal framing component of FIG. 2 to light gauge steel framing members.
Figure 4:
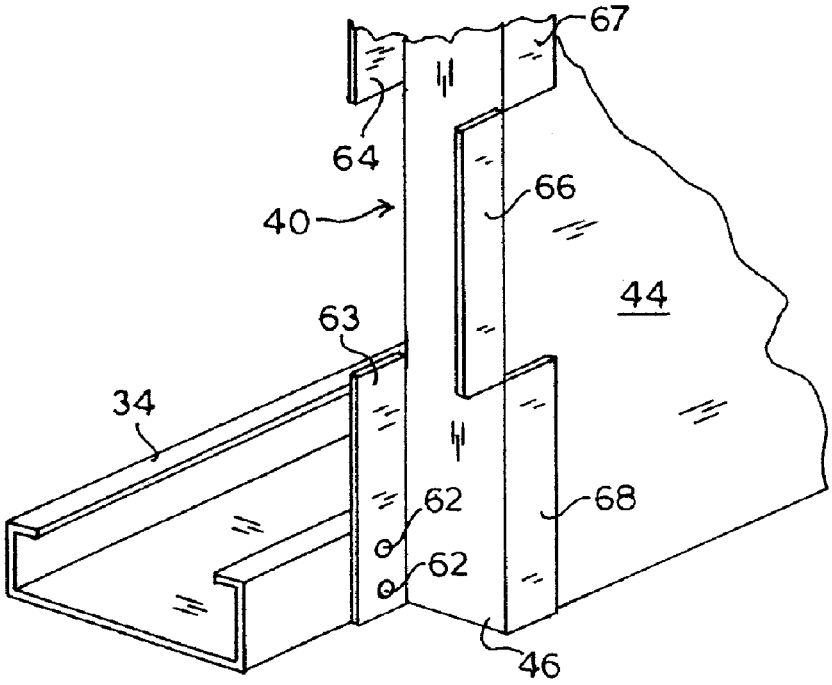
Figure 5:
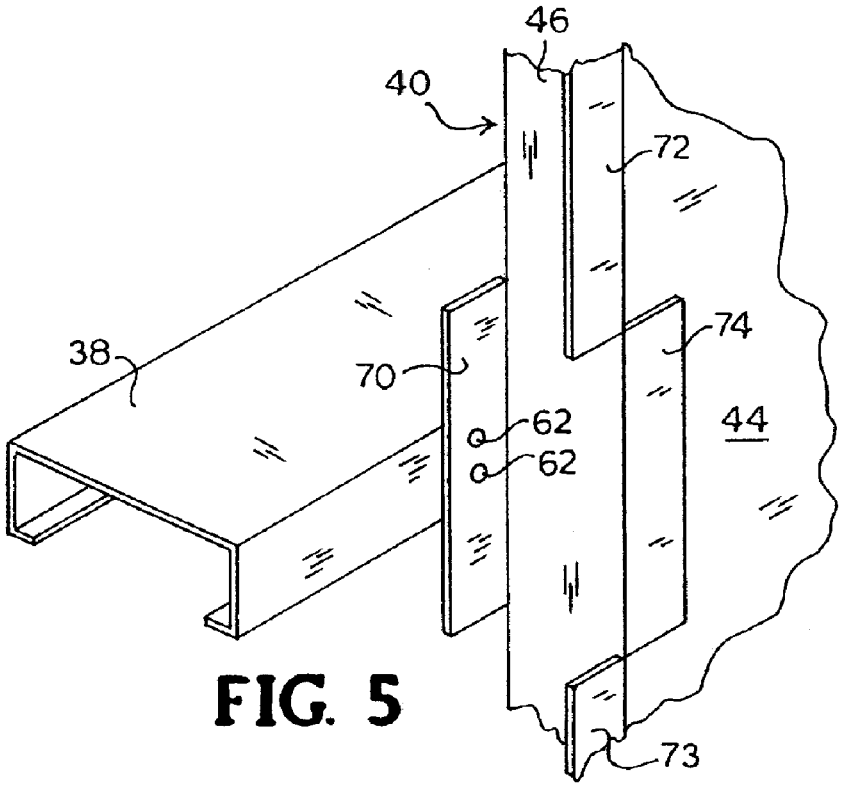

FIGS. 3-8 show how this clear access is provided, allowing a hammer, screwdriver, or other tool to be used to fasten a thermal framing component 40 to framing members. In FIGS. 3-5 a connection of a thermal framing component 40 to light gauge steel framing is shown. FIG. 3 shows a connection to the top plate 32. The thermal component 40 extends to present an inner tab 56 to the top plate 32. Inner tab 56 and outer tab 58 define a slot into which insulation 44 (not shown) may be placed. Outer tab 60 and inner tabs (not visible in FIG. 3) define another slot into which insulation 44 is placed. Outer tabs 58, 60 may present mounting locations for exterior sheathing or finish material. Two fasteners 62 are shown, which may be screws or the like. Regardless of the material of the framing member to which the thermal framing component is to be mounted, nails, screws or other fasteners as known to one of ordinary skill in the art may be used.

FIGS. 4 and 5 show similar connections to the bottom plate 34 and to mid-span blocking 38, respectively. In FIG. 4 an inner tab 63 is attached to the bottom plate 34 with fasteners 62. Insulation 44 may be disposed in a slot formed by the inner tabs 63-64 and outer tab 66. Outer tabs 67-68 form one side of the slot in which insulation 44 is disposed. In FIG. 5, an inner tab 70 is attached to the mid-span blocking 38 with fasteners 62, and the inner and outer tabs 70, 72-73 form an insulation slot. Outer tab 74 forms one side of the opposing slot.

Figure 6:
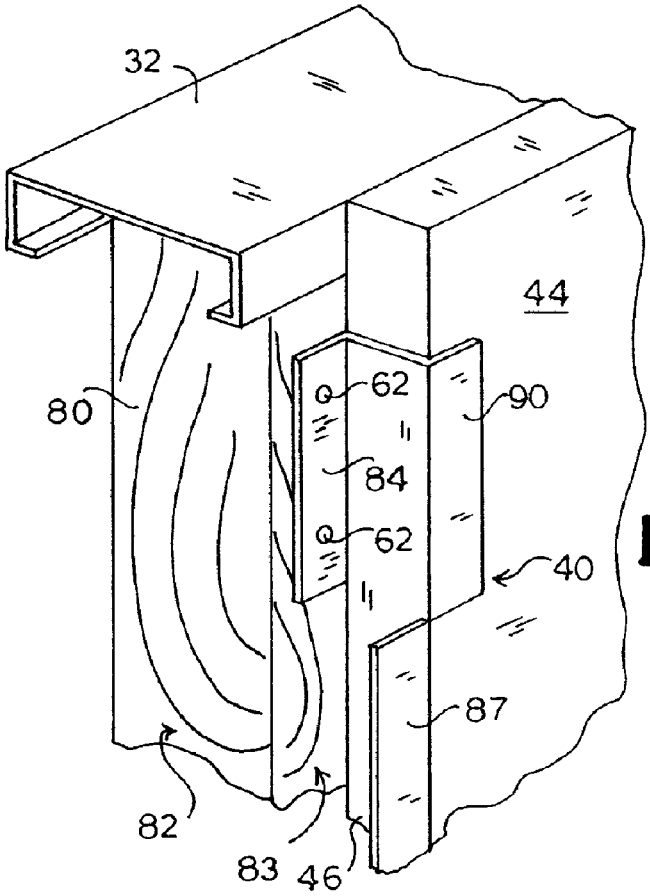
FIGS. 6-8 are perspective views of alternative connections of the thermal framing component of FIG. 2 to wood framing members.
Figure 7:
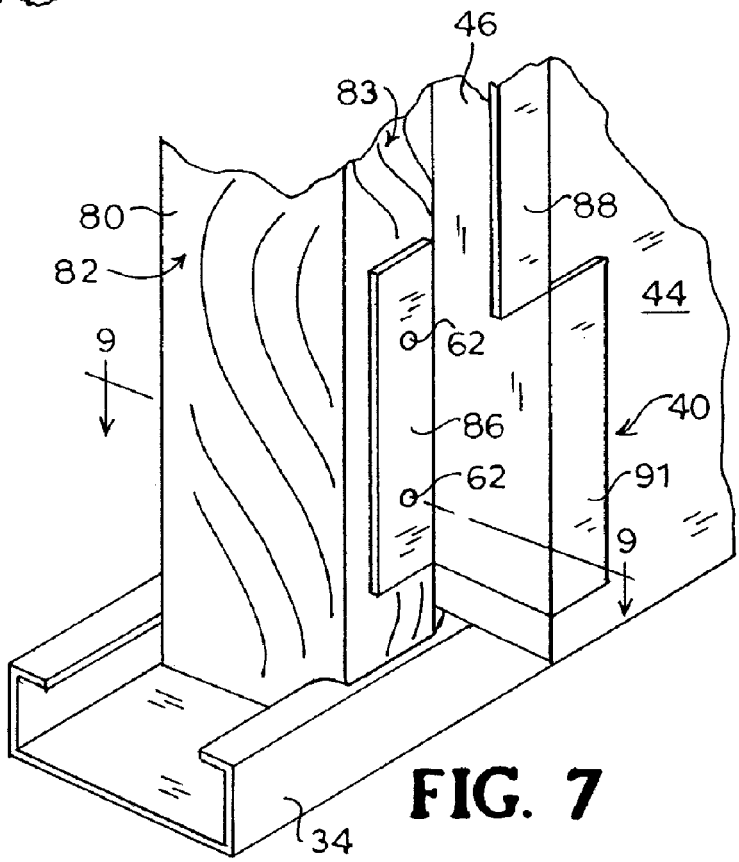
Figure 8:
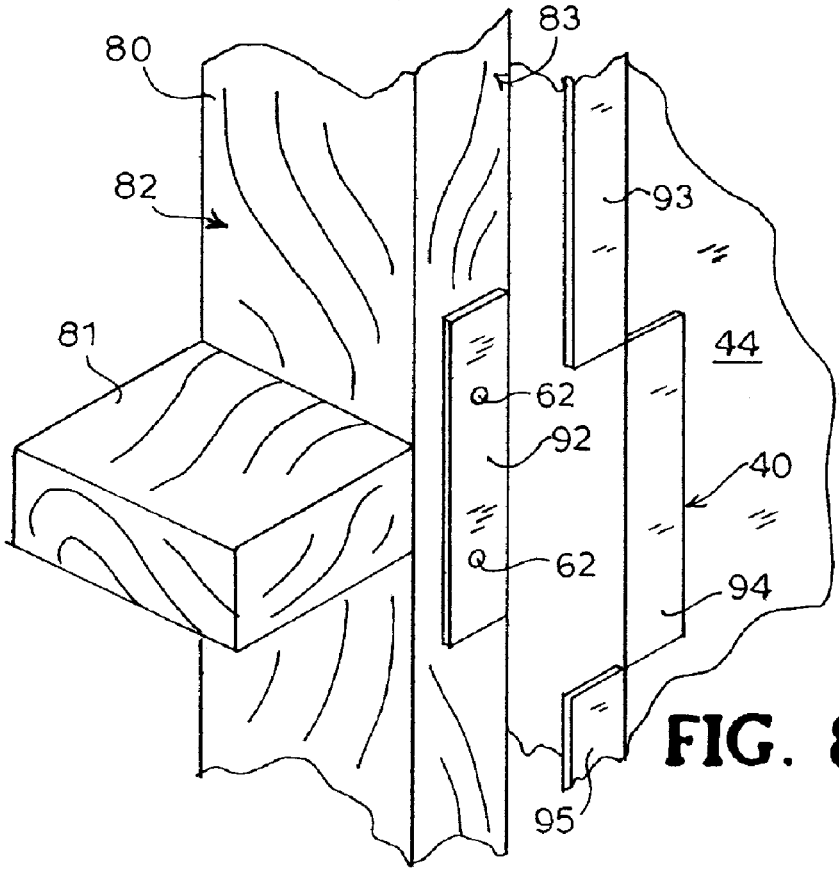

In FIGS. 6-8 a connection of a thermal framing component 40 to a wood stud 80 incorporated into light gauge steel framing is shown. Wood mid-span blocking 82 is also shown (FIG. 8). The top and bottom plates 32, 34 could also be made of wood. Studs, regardless of material, may be considered to have a web 82, which is in cross-section along the longer dimension, and a flange 83, which in cross-section is along the shorter dimension. The thermal component 40 is shown to stop short of contact with the metal plates 32, 34.

In FIGS. 6 and 7 the mounting of the component 40 is made near, but not to, the top plate 32 and bottom plate 34, and to the wall stud flange 83, with fasteners 62. The component 40 secures insulation 44 as discussed above. The connections could be made directly to the plates 32, 34 as in FIGS. 3-5. Connecting instead only to the wood stud 80 or other wood members, however, can assist in reducing heat transfer by eliminating a direct metal to metal connection. Inner tabs 84, 86 and outer tabs 87-88 in FIGS. 6 and 7 respectively form insulation slots. Inner tabs 84, 86 provide surfaces for mounting to the framing. Outer tabs 90, 91 form one side of an insulation slot. The outer tabs 87, 88, 90, 91 provide surfaces for mounting of finish material or exterior sheathing.

FIG. 8 shows the component 40 connected to the stud 80 at the mid-span blocking 82 made with fasteners 62. The component 40 may also be connected at various locations along the stud 80. Inner and outer tabs 92-95 again form sides of the insulation slots and present mounting locations.

Figure 9:
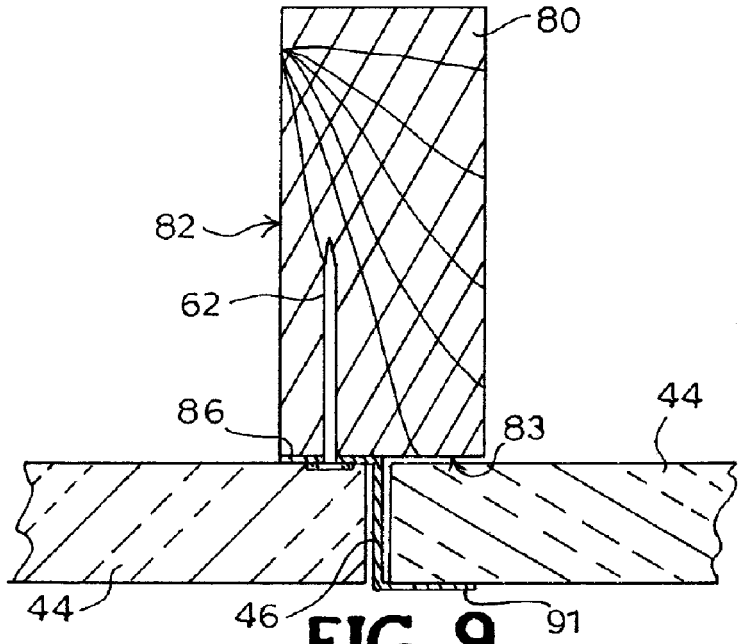
FIG. 9 is a section view of the thermal framing component connection to a wood framing member taken along line 9-9 of FIG. 7.

FIG. 9 shows a section view of the thermal framing component 40 of FIGS. 6-8, with rigid insulation 44 installed, taken along line 9-9 in FIG. 7. The thermal component is fastened to the wood stud 80 with a nail 62. As previously discussed, other fasteners as known to one of ordinary skill in the art could be used. The edge of the rigid insulation 44 may be in close and complementary registration with the web 46. The inner tab 86 provides a surface for mounting to the stud 80, while the outer tab 91 is used to secure the rigid insulation 44 and provide a mounting surface for exterior sheathing or finish material.

Figure 10:
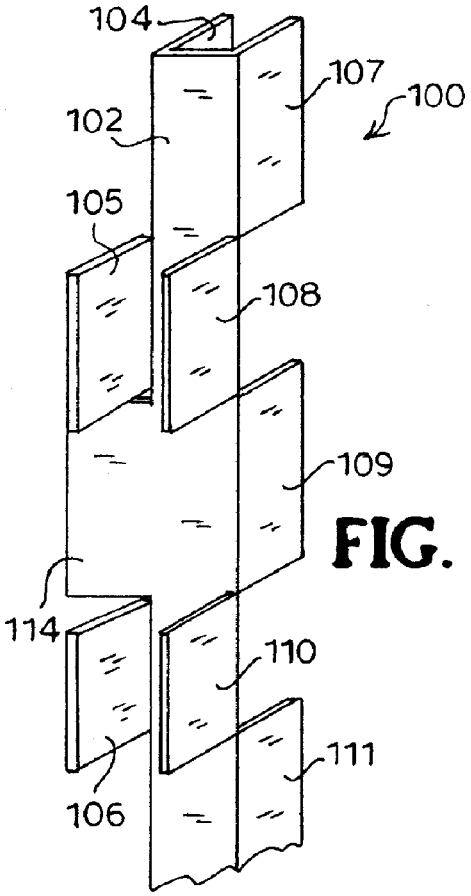
FIG. 10 is a perspective view of another embodiment of a thermal framing component according to the present invention.
Figure 11:
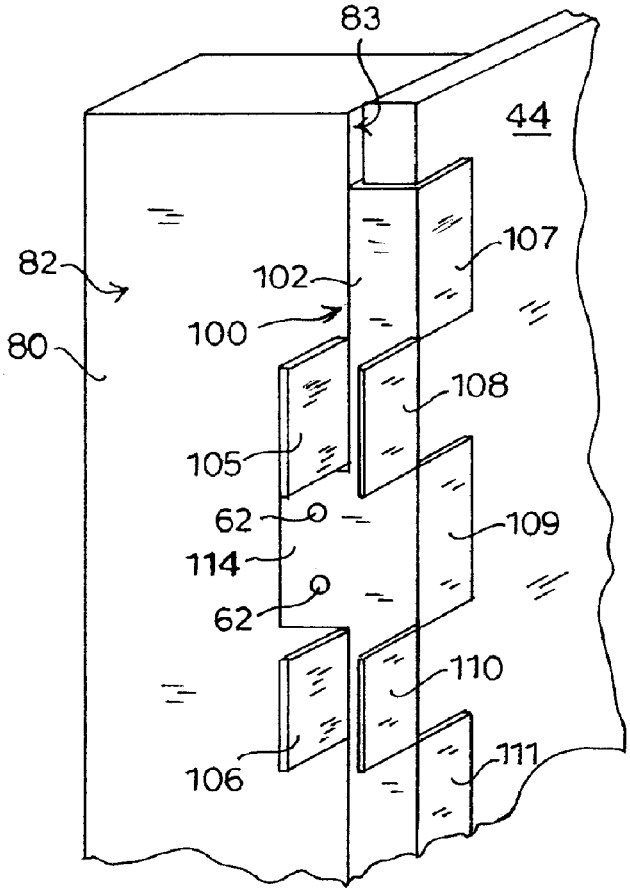
FIG. 11 is a perspective view of a connection of the thermal framing component of FIG. 10 to a framing member.

FIG. 10 shows another embodiment of a thermal framing component 100 in accordance with the present invention. This portion of a thermal component 100 includes a web 102, inner tabs 104-106, and outer tabs 107-111. Partially hidden tab 104 resembles the other tabs 105-111. Similar inner tabs that oppose outer tabs 109, 111 are not visible in FIG. 10. Another tab 114 extends from the web 102 in the same plane as the web 102. As shown in FIG. 11, this tab 114 provides a mounting surface to mount the thermal component 100 to the stud web 82 rather than the stud flange 83. Bent tabs 104-111 may be bent in either direction so long as a slot is formed to receive insulation 44.

In installation, a thermal component may be mounted, for example, to a top plate and bottom plate, or to a wall stud, or combination thereof. Then one vertical edge of rigid insulation is inserted into the slot formed by the tabs. Another thermal component is positioned onto the free vertical edge of the insulation, and is then mounted to the desired parts. This process may be repeated to install the thermal components and insulation along the wall. Alternatively, more than one thermal component may be mounted prior to placement of the rigid insulation, and the rigid insulation may be slid into the slot or slots formed by the tabs, either from the bottom or the top.

Specific embodiments of an invention are described herein. One of ordinary skill in the structural engineering arts will recognize that the invention has other applications in other environments. For example, sheet materials other than rigid foam insulation may be secured by the thermal framing components. In addition, the recitation "means for" is intended to evoke a means-plus-function reading of an element in a claim, whereas, any elements that do not specifically use the recitation "means for," are not intended to be read as means-plus-function elements, even if they otherwise include the word "means." The following claims are in no way intended to limit the scope of the invention to the specific embodiments described.

What is claimed is:

1. A thermal framing assembly for use in wall framing, comprising:

a top plate;

a bottom plate substantially parallel to and spaced from the top plate;

two spaced vertical studs, each including a stud upper end and a stud lower end, the stud upper end mounted to the top plate and stud lower end mounted to the bottom plate;

a thermal framing component interposed between the vertical studs and including a component upper end and a component lower end, the component upper end mounted to the top plate and component lower end mounted to the bottom plate, including:

an elongated planar web including a longitudinal axis, a first edge parallel to the longitudinal axis, a second edge parallel to the longitudinal axis, a first side, and a second side;

a first planar tab extending from the first edge at approximately a 90 degree angle from the first side;

a second planar tab extending from the first edge at approximately a 90 degree angle from the second side in a direction opposite that of the first tab;

a third planar tab extending from the second edge at approximately a 90 degree angle from the second side in the direction opposite that of the first tab; and a fourth planar tab extending from the second edge at approximately a 90 degree angle from the first side in the direction opposite the third tab, wherein the third tab is in longitudinal registration with the first tab, wherein the fourth tab is in longitudinal registration with the second tab, and wherein the second tab is longitudinally adjacent to the first tab, and rigid insulation having an edge in close and complementary registration with a side of the web, wherein the first and second tabs are entirely within the same plane and the third and fourth tabs are entirely within the same plane.

2. The thermal framing assembly of claim 1, further comprising mid-span blocking, wherein the thermal framing component is mounted to the mid-span blocking.

3. An assembly for use in wall framing, comprising:

a top plate;

a bottom plate substantially parallel to and spaced from the top plate;

two spaced vertical studs, each including a stud upper end and a stud lower end, the stud upper end mounted to the top plate and stud lower end mounted to the bottom plate; and a strip interposed between the vertical studs and including a strip upper end and a component lower end, the strip upper end mounted to the top plate and strip lower end mounted to the bottom plate, including:

an elongated planar web including a longitudinal axis, a first edge parallel to the longitudinal axis, a second edge parallel to the longitudinal axis, a first side, and a second side;

a first planar tab extending from the first edge at approximately a 90 degree angle from the first side;

a second planar tab extending from the first edge at approximately a 90 degree angle from the second side in a direction opposite that of the first tab;

a third planar tab extending from the second edge at approximately a 90 degree angle from the second side in the direction opposite that of the first tab; and a fourth planar tab extending from the second edge at approximately a 90 degree angle from the first side in the direction opposite the third tab, wherein the third tab is in longitudinal registration with the first tab, wherein the fourth tab is in longitudinal registration with the second tab, and wherein the second tab is longitudinally adjacent to the first tab.

4. The assembly of claim 3, further comprising rigid insulation having an edge in close and complementary registration with a side of the web.

5. The assembly of claim 3, further comprising mid-span blocking, wherein the component is mounted to the mid-span blocking.

6. The assembly of claim 3, wherein the first and second tabs are entirely within the same plane and the third and fourth tabs are entirely within the same plane.

7. The assembly of claim 3, wherein the first and second tabs are free of apertures.

* * * * *

UNITED STATES PATENT AND TRADEMARK OFFICE

CERTIFICATE OF CORRECTION

PATENT NO. : 7,617,648 B2
APPLICATION NO. : 10/711118
DATED : November 17, 2009
INVENTOR(S) : Donald R. Moody It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 865 days.

Signed and Sealed this

Nineteenth Day of October, 2010

David J. Kappos

David J. Kappos
*Director of the United States Patent and Trademark Office*